US009139911B2

(12) United States Patent
Wu et al.

(10) Patent No.: US 9,139,911 B2
(45) Date of Patent: Sep. 22, 2015

(54) FABRICATION METHODS FOR CHEMICAL COMPOUND THIN FILMS

(71) Applicant: Industrial Technology Research Institute, Hsinchu (TW)

(72) Inventors: Chung-Shin Wu, Kaohsiung (TW); Pei-Sun Sheng, Taipei (TW); Wei-Tse Hsu, Taoyuan County (TW)

(73) Assignee: Industrial Technology Research Institute, Hsinchu (TW)

( * ) Notice: Subject to any disclaimer, the term of this patent is extended or adjusted under 35 U.S.C. 154(b) by 82 days.

(21) Appl. No.: 14/177,151

(22) Filed: Feb. 10, 2014

(65) Prior Publication Data

US 2014/0161979 A1 Jun. 12, 2014

Related U.S. Application Data

(62) Division of application No. 12/890,021, filed on Sep. 24, 2010, now Pat. No. 8,683,942.

(30) Foreign Application Priority Data

Jun. 23, 2010 (TW) ..... 99120394 A

(51) Int. Cl.

| | |
|---|---|
| ***C23C 18/02*** | (2006.01) |
| ***C23C 18/16*** | (2006.01) |
| ***C23C 18/54*** | (2006.01) |
| ***C23C 18/12*** | (2006.01) |
| ***B05D 1/18*** | (2006.01) |
| ***B05D 3/02*** | (2006.01) |

(52) U.S. Cl.

CPC . *C23C 18/02* (2013.01); *B05D 1/18* (2013.01); *B05D 3/0218* (2013.01); *C23C 18/12* (2013.01); *C23C 18/1204* (2013.01); *C23C 18/1291* (2013.01); *C23C 18/1601* (2013.01); *C23C 18/1633* (2013.01); *C23C 18/54* (2013.01); *C23C 18/163* (2013.01); *C23C 18/1614* (2013.01); *C23C 18/1619* (2013.01)

(58) Field of Classification Search

CPC ..... B05D 1/18; B05D 13/0218; C23C 18/02; C23C 18/12; C23C 18/1204; C23C 18/1291; C23C 18/1601; C23C 18/16; C23C 18/1614; C23C 18/1619; C23C 18/163; C23C 18/1633; C23C 18/54

See application file for complete search history.

(56) References Cited

U.S. PATENT DOCUMENTS 4,335,266 A 6/1982 Mickelsen et al.
6,824,612 B2 11/2004 Stevens et al.

(Continued)

OTHER PUBLICATIONS

Taiwan Patent Office, Office Action, Patent Application Serial No. 99120394, Feb. 26, 2013, Taiwan.

*Primary Examiner* — James M Mellott

(57) ABSTRACT

Chemical bath deposition (CBD) apparatuses and fabrication methods for compound thin films are presented. A chemical bath deposition apparatus includes a chemical bath reaction container, a substrate chuck for fixing a substrate arranged face-down toward the bottom of the chemical bath reaction container, multiple solution containers connecting to a reaction solution mixer and further connection to the chemical bath reaction container, and a temperature control system including a first heater controlling the temperature of the chemical bath reaction container, a second heater controlling the temperature of the substrate chuck, and a third heater controlling the temperature of the multiple solution containers.

10 Claims, 8 Drawing Sheets

(56) References Cited

U.S. PATENT DOCUMENTS

| | | | | |
|---|---|---|---|---|
| 7,138,014 | B2 | 11/2006 | Stevens et al. | |
| 7,541,067 | B2 | 6/2009 | Basol | |
| 7,690,324 | B1 * | 4/2010 | Feng et al. | 118/52 |
| 8,683,942 | B2 * | 4/2014 | Wu et al. | 118/423 |
| 2003/0141018 | A1 * | 7/2003 | Stevens et al. | 156/345.51 |
| 2006/0081180 | A1 | 4/2006 | Aoki et al. | |
| 2007/0080067 | A1 * | 4/2007 | Gu et al. | 205/183 |
| 2009/0223444 | A1 | 9/2009 | Basol | |
| 2009/0246908 | A1 | 10/2009 | Basol et al. | |
| 2009/0255461 | A1 | 10/2009 | Basol | |

* cited by examiner

FABRICATION METHODS FOR CHEMICAL COMPOUND THIN FILMS

CROSS REFERENCE TO RELATED APPLICATIONS

This application claims the benefit of priority from, and is a divisional application of, U.S. patent application Ser. No. 12/890,021, now U.S. Pat. No. 8,683,942, filed on Sep. 24, 2010, entitled "Chemical bath deposition apparatuses and fabrication methods for chemical compound thin films", which claims the benefit of priority from Taiwan Application No. 099120394, filed on Jun. 23, 2010, and the entire contents of which are incorporated herein by reference.

TECHNICAL FIELD

The disclosure relates to an apparatus and method for fabricating chemical compound thin films, and in particular to, chemical bath deposition apparatuses and fabrication methods for chemical compound thin films.

BACKGROUND

Chemical bath deposition (CBD) method has bend developed as a well-known thin film technique, which was first announced by the Boeing Company in 1982. Advantages of the chemical bath deposition technique include easy implementation, low equipment cost, and high quality coating, etc. Conventionally, when implementing the chemical bath deposition process to prepare a thin film, the working piece will be vertically placed in the plating container where the chemical solution is heated. It should be understood, however, that thermal field and flow field deposition in the chemical bath container may directly affect uniformity of the coating layers. Therefore, the thermal field of the chemical bath container and the flow field of the reaction solution must be precisely controlled.

Generally, there are two main nucleation mechanisms during the chemical bath deposition process: homogeneous nucleation and heterogeneous nucleation. Heterogeneous nucleation occurs when anions and cations in the solution react to formations of nuclei in a heterogeneous interface. After proceeding subsequent chemical ion reactions, the nuclei continue to stack and grow and transforms into a thin film on the heterogeneous interface, wherein the heterogeneous interface can be a solid-liquid interface or a gas-liquid interface. On the other hand, homogeneous nucleation occurs when anions and cations directly react into nuclei in solution. After proceeding subsequent chemical ion reactions, the nuclei continue to stack and grow and transforms into suspended particles in the solution.

For conventional chemical bath deposition process, the presence of suspended particles is an important problem to overcome. The main problem is that the suspended particles may attach to the thin film during plating process, undermining the uniformity of film thickness. For example, when a large area thin film is prepared using vertical chemical bath deposition, a higher amount of suspended particles may occur at the bottom of the chemical bath container, affecting uniformity and surface smoothness of the coating layer in the bottom of the chemical bath container.

According to the abovementioned discuss, the conventional chemical bath deposition process has two major problems which must be overcome, namely; uniformity of thermal field distribution and deposition of suspended particles. Particularly, during deposition of large area thin films, these two effects may become more apparent.

In order to address the issue of thermal field distribution, U.S. Pat. No. 7,541,067 and U.S. Pat. Publication Nos.: 2009/0246908, 2009/0255461, 2009/0223444, the entirety of which are incorporated herein by reference, disclose a chemical bath deposition (CBD) method with the face-up placement of the substrate which directly heats the substrate instead of the solution to address the issue of the thermal field distribution. FIG. 1 is a schematic view illustrating a conventional chemical bath deposition apparatus. In FIG. 1, a chemical bath deposition apparatus 10 includes a chemical bath deposition section 11 where the reaction solution flows from an inlet port 13 to an outlet port 14. A substrate 18 is disposed at the bottom of the chemical bath deposition section 11. The surface 18A of the substrate 18 is arranged faced upward. The reaction solution in the chemical bath deposition section 11 was maintained at temperature within a range between 55-80° C. The substrate 18 is heated up by a heater 19. A cooling device 29A is disposed on the top of the chemical bath deposition section 11 constructed as a cold-wall reactor. Chemical compound thin film deposited on the top surface 11A of the chemical bath deposition section 11 can thus be prevented.

The deposition method implemented by the chemical bath deposition apparatus 10 is advantageous in that less reactive solution can be consumed to achieve the same thin film quality. Although the abovementioned method can successfully address the thermal field distribution and flow field distribution issues, deposition of the suspended particles in the solution cannot be effectively avoided. Large quantities of suspended particles may be deposited on the substrate surface, affecting the coated thin film quality.

There are some prior techniques which reduce the solution temperature to avoid occurrence of the suspended particles and polishing and flattening the surface of the coating layer after completion of thin film deposition. Reducing the solution temperature, however, would result in increased deposition time. Accordingly, a chemical bath deposition apparatus is eagerly needed to effectively address the issue of thermal field distribution and to effectively reduce and prevent the suspended particles deposited on the substrate surface.

SUMMARY

According to one embodiment, a chemical bath deposition apparatus, comprising: a chemical bath reaction container; a substrate chuck for fixing a substrate arranged face toward the bottom of the chemical bath reaction container; multiple solution containers connecting to a reaction solution mixer and further connected to the chemical bath reaction container; and a temperature control system including a first heater controlling the temperature of the chemical bath reaction container, a second heater controlling the temperature of the substrate chuck, and a third heater controlling the temperature of the multiple solution containers.

According to another embodiment, a chemical bath deposition apparatus, comprising: a chemical bath reaction container; a substrate chuck for fixing a substrate arranged facing toward the bottom of the chemical bath reaction container; a swing arm device for controlling an immersion angle of the substrate chuck into the chemical bath reaction container; multiple solution containers connecting to a reaction solution mixer and further connecting to the chemical bath reaction container; and a temperature control system including a first heater controlling the temperature of the chemical bath reaction container, a second heater controlling the temperature of the substrate chuck, and a third heater controlling the temperature of the multiple solution containers, wherein the chemical bath reaction container comprises a plurality of positioning piles placed in the bottom of the container to fix a distance between the substrate chuck and the bottom of the container.

According to another embodiment, a method for fabricating a chemical compound thin film, comprising: providing the chemical bath deposition apparatus including a chemical bath reaction container; a substrate chuck for fixing a substrate arranged face toward the bottom of the chemical bath reaction container; a swing arm device for controlling an immersion angle of the substrate chuck into the chemical bath reaction container; multiple solution containers connecting to a reaction solution mixer and further connection to the chemical bath reaction container; and a temperature control system including a first heater controlling the temperature of the chemical bath reaction container, a second heater controlling the temperature of the substrate chuck, and a third heater controlling the temperature of the multiple solution containers, wherein the chemical bath reaction container comprises a plurality of positioning piles placed in the bottom of the container to fix a distance between the substrate chuck and the bottom of the container; fixing a substrate to the substrate chuck; controlling a tilt angle of the substrate chuck immersed into the chemical bath reaction container, thereby reducing generation the rate of bubbles; and undergoing an oxidation-reduction reaction in the chemical bath reaction container to deposit the chemical compound thin film on the substrate.

BRIEF DESCRIPTION OF THE DRAWINGS

The disclosure can be more fully understood by reading the subsequent detailed description and examples with references made to the accompanying drawings, wherein.

DETAILED DESCRIPTION

Figure 1:
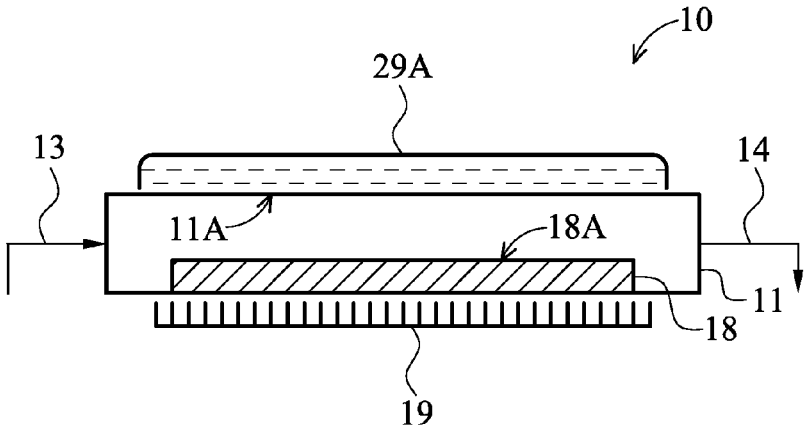
FIG. 1 (PRIOR ART)
FIG. 1 is a schematic view illustrating a conventional chemical bath deposition apparatus.

It is understood that the following disclosure provides many different embodiments, or examples, for implementing different features of various embodiments. Specific examples of components and arrangements are described below to simplify the present disclosure. These are merely examples and are not intended to be limited. In addition, the present disclosure may repeat reference numerals and/or letters in the various examples. This repetition is for the purpose of simplicity and clarity and does not in itself indicate a relationship between the various embodiments and/or configurations discussed. Moreover, the formation of a first feature over or on a second feature in the description that follows may include embodiments in which the first and second features are formed in direct contact or not in direct contact.

According to some embodiments of the present disclosure, a chemical bath deposition apparatus is provided for preparation of chemical compound thin films. Based on the chemical bath deposition technologies, the direction of the coating surface changes the plating bath system to improve the quality of coating layers. In some embodiments, the coating surface of the substrate can be arranged to face downward, and thermal field uniformity of the solution in the chemical bath deposition container improves the uniformity of the coating layer. Moreover, the chemical bath deposition equipment can optionally include a special design for removing air bubbles and a design for mixing a reaction solution, to ensure the quality of large area coating layer.

Figure 2:
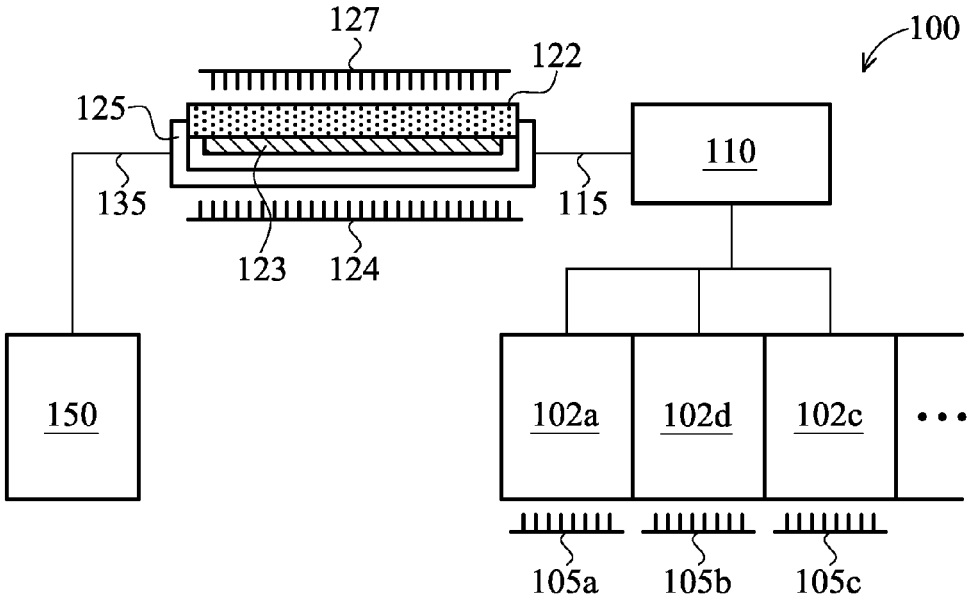
FIG. 2 is a schematic view illustrating an embodiment of a chemical bath deposition apparatus of the invention.

FIG. 2 is a schematic view illustrating an embodiment of a chemical bath deposition apparatus of the invention. Referring to FIG. 2, a chemical bath deposition apparatus 100 includes a chemical bath reaction container 125. A substrate chuck 122 is provided for fixing a substrate 123 arranged facing toward the bottom of the chemical bath reaction container 125. A swing arm device (also shown in FIGS. 5A-5G and FIGS. 6A-6G) is provided for controlling an immersion angle of the substrate chuck into the chemical bath reaction container. In one embodiment, the swing arm device can comprise a suspension swing device and a retractable pile swing device. Multiple solution containers 102*a*, 102*b* and 102*c* connect to a reaction solution mixer 110 respectively and further connect to the chemical bath reaction container 125. The mixed reaction solution flows from an inlet port 115 to an outlet port 135. The chemical bath deposition apparatus 100 can further include an additional filter and waste storage tank 150. A temperature control system includes a first heater 124 controlling the temperature of the chemical bath reaction container 125, a second heater 127 controlling the temperature of the substrate chuck 122, and third heaters 105*a*, 105*b*, 105*c* controlling the temperature of the multiple solution containers 102*a*, 102*b* and 102*c*, wherein the chemical bath reaction container 125 comprises a plurality of positioning piles placed in the bottom of the container to fix a distance between the substrate chuck and the bottom of the container The chemical bath reaction container 125 is a space to accommodate the reaction solution. During deposition, the chemical bath reaction container 125 and the substrate chuck 122 are sealed to create a closed space. In one embodiment, the design of heating system includes three parts: a first heating device in the substrate chuck, a second heating device in the chemical bath reaction container, and a third heating device in the reaction solution storage containers. The first heating device is used for heating up the substrate chuck. The goal of heating the chemical bath reaction container is to maintain temperature of the reaction solution. The goal of heating the solution storage container is to pre-heat the solution in each storage container such that the mixed solution can immediately react, shortening the processing time. It should be noted that the heating mechanism of the temperature control system comprises a filament heating, a hydrothermal heating, an oil heating, and an infrared heating.

In another embodiment, feeding the reaction solution may consist of two main steps: one is respectively storing the processing solutions needed to proceed chemical reaction in different containers 102*a*, 102*b* and 102*c* to prevent pre-reaction; the other is mixing each processing solution in the reaction solution mixer 110 before entering the chemical bath reaction container. The reaction solution mixer 110 may include a spiral tube mixing device, a blade mixing device, or an eddy current mixing device. The reaction solution containers 102*a*, 102*b* and 102*c* include heating devices to separately heat the processing solutions.

Figure 3A:
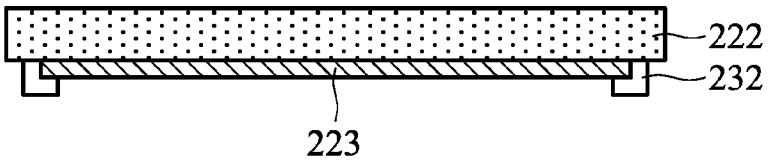
FIGS. 3A-3D are schematic views illustrating various embodiments of holding the substrate on the substrate chuck.
Figure 3B:
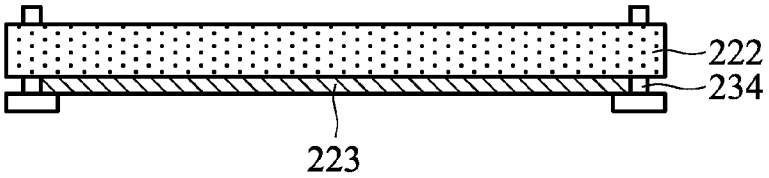
Figure 3C:
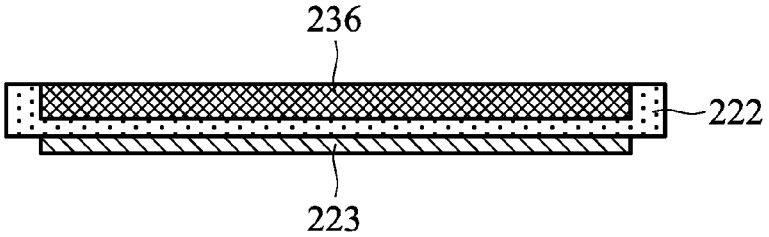
Figure 3D:
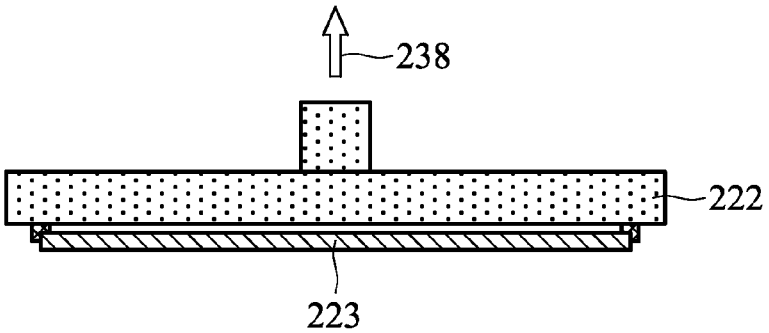

In some embodiments, the substrate 123 is arranged in a direction facing down and fixed to the substrate chuck 122. During the chemical bath deposition process, the coating surface of the substrate is arranged face-down and immersed into the reaction solution. It should be understood that holding the substrate 123 can be achieved by any suitable designed mechanism including a press stripe substrate fixing device, a screw substrate fixing device, a magnetic attachment substrate fixing device, or a vacuum absorption substrate fixing device. FIGS. 3A-3D are schematic views illustrating various embodiments that hold the substrate on the substrate chuck. In FIG. 3A, the substrate chuck 222 holds the substrate 223 with press stripes 232. In another embodiment, the substrate chuck 222 holds the substrate 223 by screws 234, as shown in FIG. 3B. In another embodiment, the substrate 223 is magnetically absorbed on the substrate chuck 222 by a magnetic device 236, as shown in FIG. 3C. In another embodiment, the substrate 223 is absorbed in a vacuum on the substrate chuck 222 by a pumping device 223, as shown in FIG. 3D.

Figure 4A:
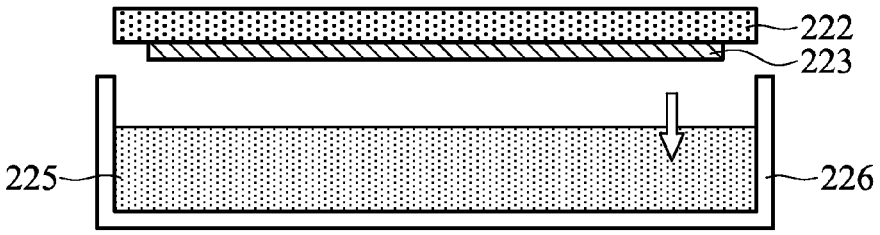
FIGS. 4A-4G are schematic views illustrating each swing step of the substrate chuck in accordance with embodiments of the invention.
Figure 4B:
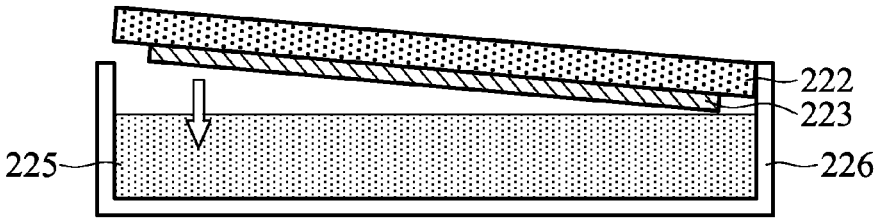
Figure 4C:
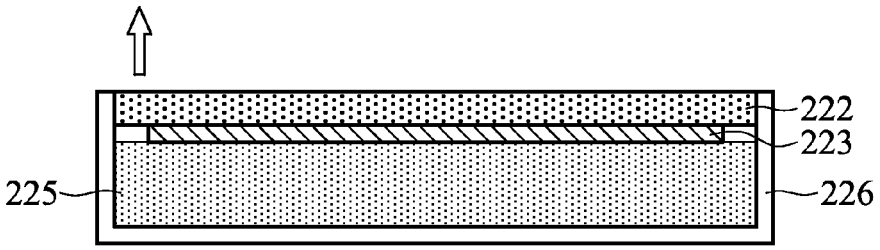
Figure 4D:
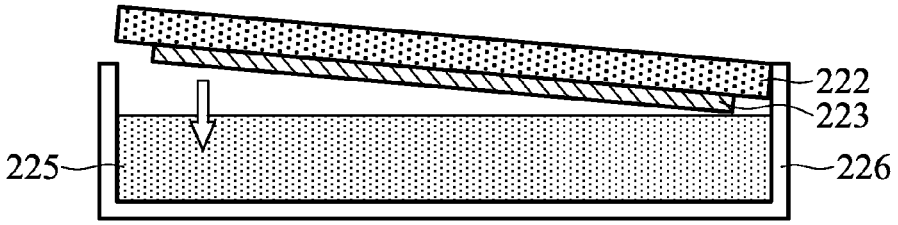
Figure 4E:
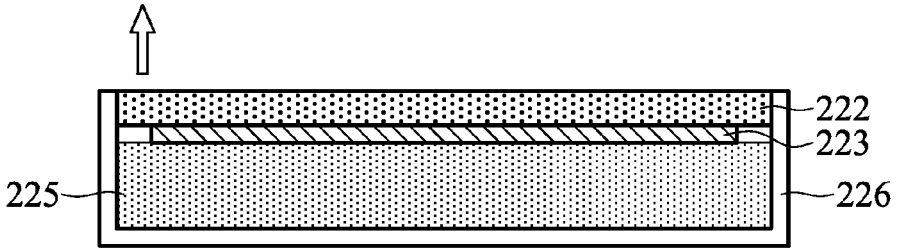
Figure 4F:
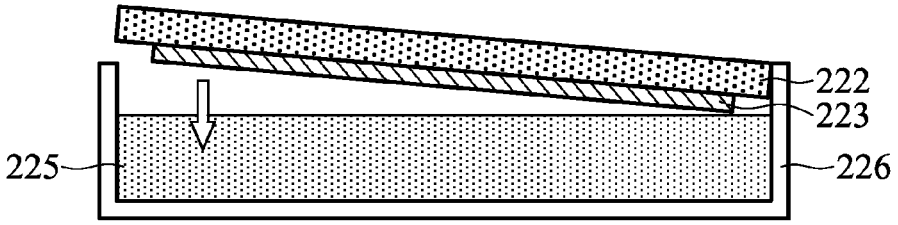
Figure 4G:
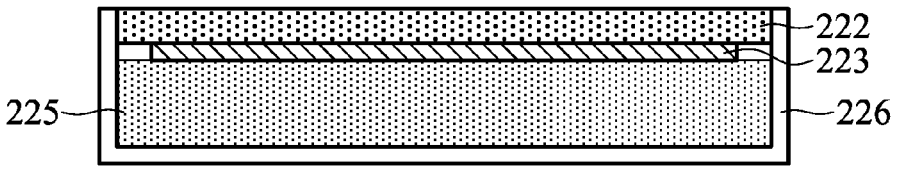

FIGS. 4A-4C are schematic views illustrating each swing step of the substrate chuck in accordance with embodiments of the invention. In FIG. 4A, a first end of the substrate chuck 222 is immersed into the reaction solution 225 in the chemical bath reaction container 226, tilting the substrate 223 at a suitable angle (also sown in FIG. 4B). Next, a second end of the substrate chuck 222 is immersed into the reaction solution 225, leveling the substrate chuck 222, as shown in FIG. 4C. Next, In FIG. 4D, the second end of the substrate chuck 222 is raised, tilting the substrate 223 at a suitable angle again. The second end of the substrate chuck 222 is immersed into the reaction solution 225, leveling the substrate chuck 222, as shown in FIG. 4E. Next, In FIG. 4F, the second end of the substrate chuck is raised, tilting the substrate chuck at a suitable angle again. The second end of the substrate chuck is immersed into the reaction solution, leveling the substrate chuck, as shown in FIG. 4G. Note that in order to effectively eliminate the bubbles, the steps of FIGS. 4E and 4F can be repeated several times.

According to some embodiments of the invention, the debubble device can be a mechanical device disposed on the substrate chuck, being able to tilt or swing the substrate chuck. The substrate first enters the reaction solution; it can tilt at a suitable angle into the reaction solution. After being wetted in the solution, the substrate leaves the reaction solution with the suitable angle. Repeated several times, the substrate surface with bubble-free condition can be reached at the beginning of chemical bath deposition.

Figure 5A:
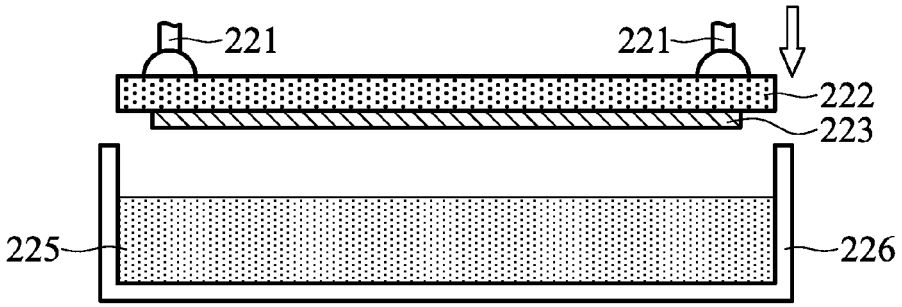
FIGS. 5A-5G are schematic views illustrating each swing step of the substrate chuck by using a suspension swing device in accordance with other embodiments of the invention.
Figure 5B:
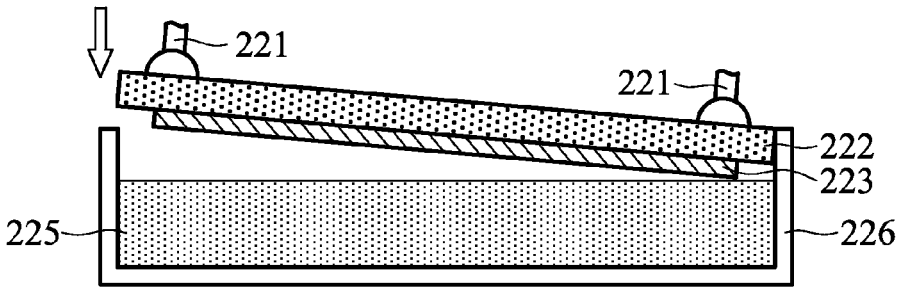
Figure 5C:
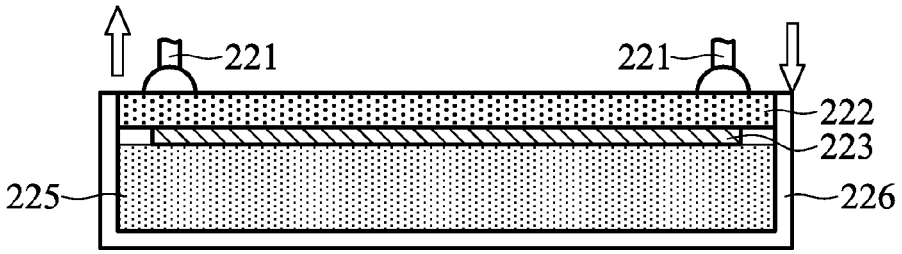
Figure 5D:
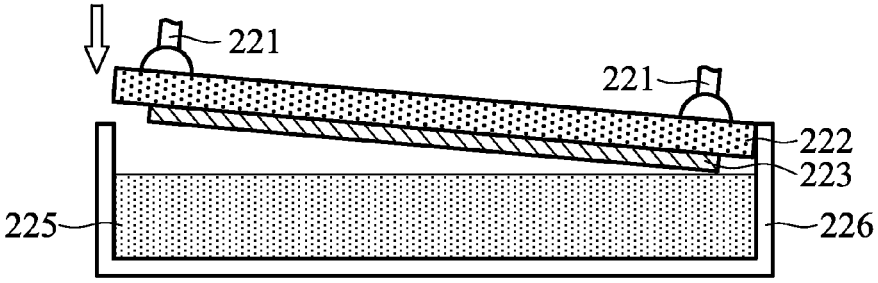
Figure 5E:
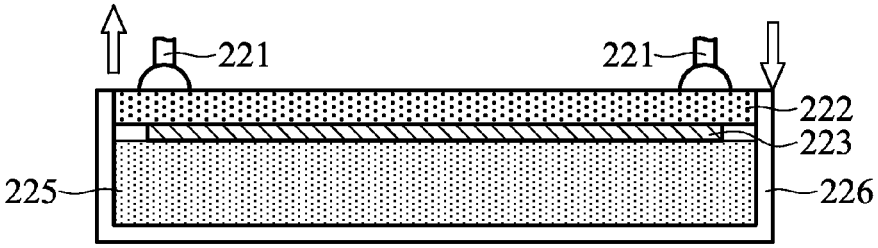
Figure 5F:
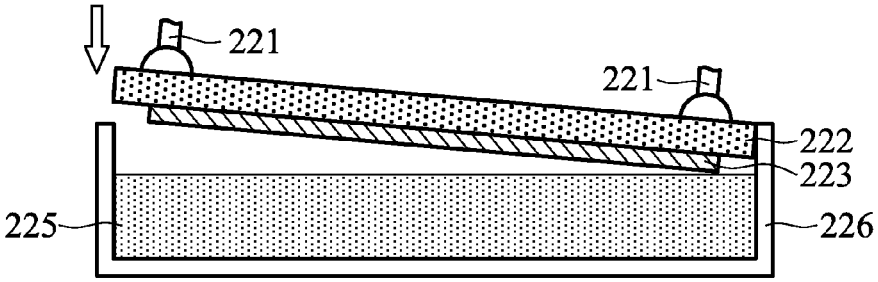
Figure 5G:
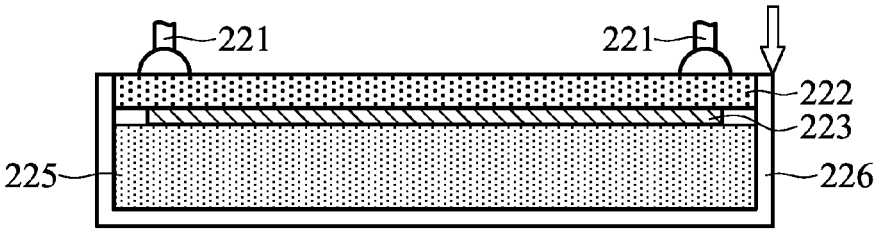

FIGS. 5A-5G are schematic views illustrating each swing step of the substrate chuck by using a suspension swing device in accordance with other embodiments of the invention. In FIG. 5A, a first end of the substrate chuck 222 is immersed into the reaction solution 225 in the chemical bath reaction container 226 by using a suspension swing device 221, tilting the substrate 223 at a suitable angle (also sown in FIG. 5B). Next, a second end of the substrate chuck 222 is immersed into the reaction solution 225, leveling the substrate chuck 222, as shown in FIG. 5C. Next, In FIG. 5D, the second end of the substrate chuck 222 is raised, tilting the substrate 223 at a suitable angle again. The second end of the substrate chuck 222 is then immersed into the reaction solution 225, leveling the substrate chuck 222, as shown in FIG. 5E. Next, In FIG. 5F, the second end of the substrate chuck is raised, tilting the substrate shuck at a suitable angle again. The second end of the substrate chuck is immersed into the reaction solution, leveling the substrate chuck, as shown in FIG. 5G.

Figure 6A:
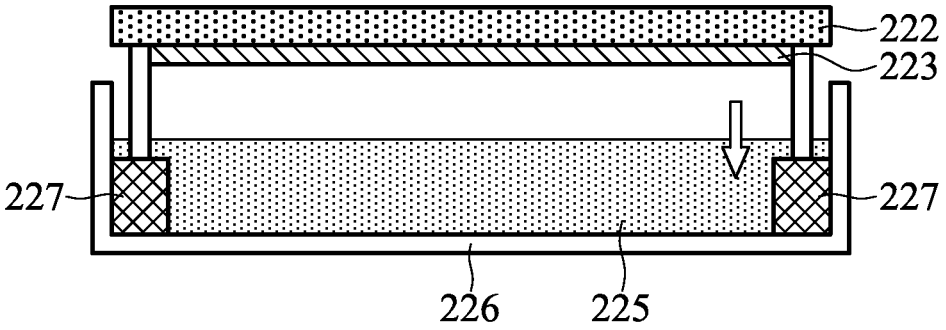
FIGS. 6A-6G are schematic views illustrating each swing step of the substrate chuck by using a retractable pile swing device in accordance with other embodiments of the invention.
Figure 6B:
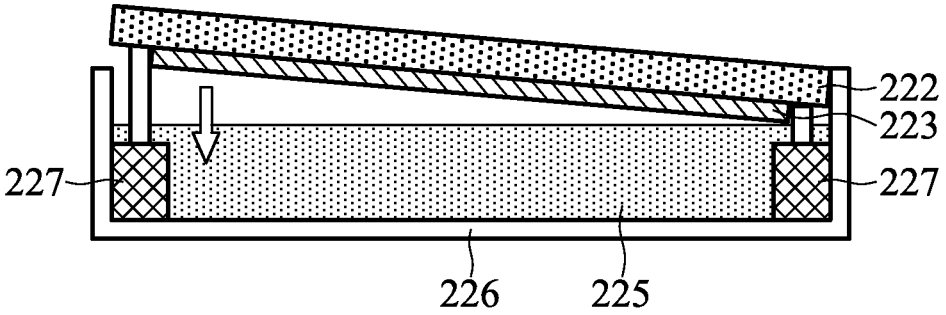
Figure 6C:
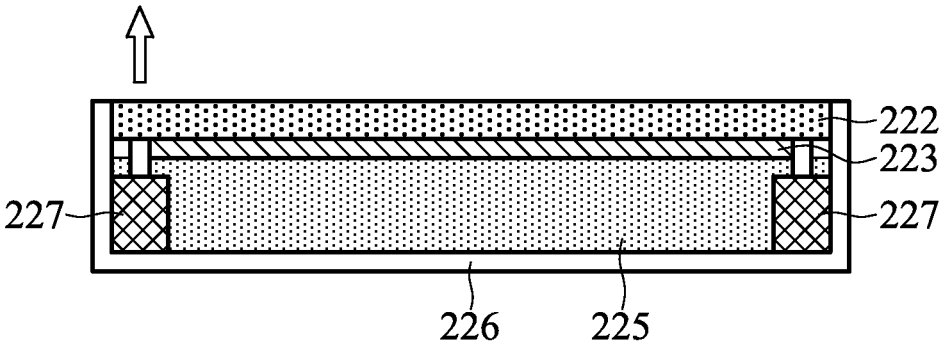
Figure 6D:
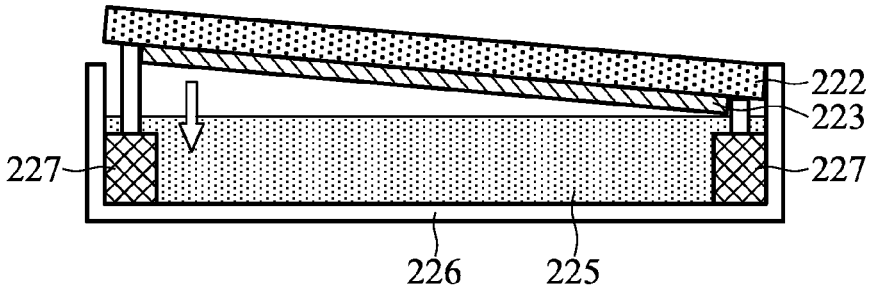
Figure 6E:
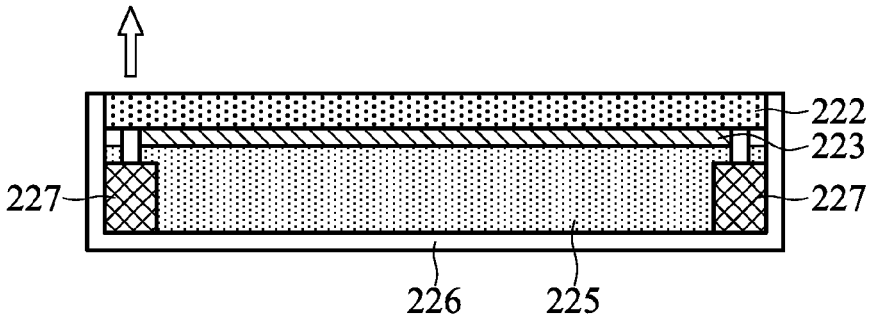
Figure 6F:
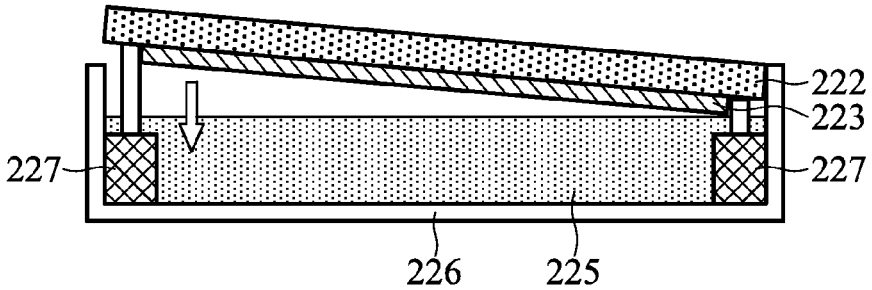
Figure 6G:
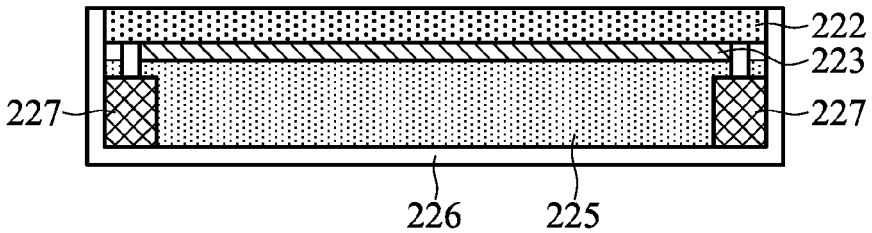

FIGS. 6A-6G are schematic views illustrating each swing step of the substrate chuck by using a retractable pile swing device in accordance with other embodiments of the invention. In FIG. 6A, the substrate chuck 222 is raised from the surface chemical reactions solution 225 by a retractable pile swing device 227 which is fixed on the bottom of the chemical bath reaction container 225. A first retractable pile is lowered to immerse a first end of the substrate chuck 222 into the reaction solution 225, tilting the substrate 223 at a suitable angle (also sown in FIG. 6B). Next, a second retractable pile is lowered to immerse a first end of the substrate chuck 222 into the reaction solution 225, leveling the substrate chuck 222, as shown in FIG. 6C. Next, In FIG. 6D, the second retractable pile is raised to lift the second end of the substrate chuck 222, thereby tilting the substrate 223 at a suitable angle again. The second retractable pile is then lowered to immerse the second end of the substrate chuck 222 into the reaction solution 225, leveling the substrate chuck 222, as shown in FIG. 6E. Next, In FIG. 6F, the second retractable pile is raised to lift the second end of the substrate chuck again, tilting the substrate shuck at a suitable angle again. The second retractable pile is then lowered to immerse the second end of the substrate chuck into the reaction solution, leveling the substrate chuck, as shown in FIG. 6G. It should be understood that the retractable pile swing device 227 can also serve as a position pin to fix the distance between the substrate chuck 222 and the bottom of the chemical bath reaction container 225.

The following are some examples of the deposition process for several chemical compound thin films by using the chemical bath deposition apparatus disclosed in the abovementioned embodiments. For example, a CdS plating bath formula (such as $CdSO_4$:$SC(NH_2)_2$:$NH_4OH$=0.0015:0.0075:1.5) is used as reaction solution. Deposition of CdS thin film is performed using the chemical bath deposition apparatus 100 shown in FIG. 2. The bath deposition temperature is 60° C. and the bath deposition time is 3 minutes. The coverage of the deposited CdS thin films is achieved at a rate exceeding 99% with excellent surface flatness and thickness of about 45 nm. In another embodiment of the invention, another CdS plating bath formula (such as $CdSO_4$:$SC(NH_2)_2$:$NH_4OH$=0.0015:0.0075:1.5) is used as reaction solution. Deposition of the CdS thin film is performed using another chemical bath deposition apparatus 100 shown in FIG. 2. The CdS thin film as deposited has a more planar surface, uniform thickness, and better transparency. In still another embodiment, an InS plating bath formula is used as a reaction solution. Deposition of InS thin film is performed using the chemical bath deposition apparatus 100 of FIG. 2. The bath deposition temperature is 70° C. and the bath deposition time is 60 minutes. The coverage of the deposited InS thin films is more than 99% with excellent surface flatness and thickness of about 58 nm. In yet another embodiment, a Zn(OH)S plating bath formula is used as reaction solution. Deposition of Zn(OH)S thin film is performed using the chemical bath deposition apparatus 100 of FIG. 2. The bath deposition temperature is 60° C. and the bath deposition time is 60 minutes. The coverage of the deposited Zn(OH)S thin films is more than 95% with slightly uneven surface and thickness of about 40 nm.

Accordingly, since the CBD method as disclosed is implemented using the chemical bath deposition apparatus with the substrate facing downwards and incorporated with the debubble device, a high quality of the large area CBD compound thin film can be maintained. Design of the chemical bath deposition apparatus includes controlling thermal field uniformity and flow field uniformity to achieve the requirements of thin film uniformity. Alternatively, the chemical bath deposition apparatus may further include a design of swing arm device (e.g., a suspension swing device or a retractable pile swing device) to remove trapped bubbles and a design of a reaction solution feeding device to achieve a large area chemical compound thin film with a smooth surface, uniform thickness, and high transparency.

While the disclosure has been described by way of example and in terms of the preferred embodiments, it is to be understood that the disclosure is not limited to the disclosed embodiments. To the contrary, it is intended to cover various modifications and similar arrangements (as would be apparent to those skilled in the art). Therefore, the scope of the appended claims should be accorded to the broadest interpretation so as to encompass all such modifications and similar arrangements.

What is claimed is:

1. A method for fabricating a chemical compound thin film, comprising:

providing a chemical bath deposition apparatus, comprising:

a chemical bath reaction container;

a substrate chuck for fixing a substrate arranged face toward the bottom of the chemical bath reaction container;

a swing arm device configured to control an immersion angle of the substrate chuck relative to a bottom surface of the chemical bath reaction container by tilting the substrate chuck and moving the tilted substrate chuck into the chemical bath reaction container, wherein the swing arm device comprises a suspension swing device connected respectively to opposing ends of the substrate chuck and configured to tilt and level the substrate chuck by raising or lowering one end of the substrate chuck relative to the other;

multiple solution containers connecting to a reaction solution mixer and further connecting to the chemical bath reaction container; and a temperature control system including a first heater controlling the temperature of the chemical bath reaction container, a second heater controlling the temperature of the substrate chuck, and a third heater controlling the temperature of the multiple solution containers, wherein the chemical bath reaction container comprises a plurality of positioning piles placed in the bottom of the container to fix a distance between the substrate chuck and the bottom of the container;

fixing a substrate to the substrate chuck;

controlling a tilt angle of the substrate chuck immersed into the chemical bath reaction container, thereby reducing the generation rate of bubbles; and undergoing an oxidation-reduction reaction in the chemical bath reaction container to deposit the chemical compound thin film on the substrate.

2. The method for fabricating a chemical compound thin film as claimed in claim 1, wherein the substrate comprises a rigid substrate or a flexible substrate.

3. The method for fabricating a chemical compound thin film as claimed in claim 1, wherein the substrate chuck directly heats up the substrate.

4. The method for fabricating a chemical compound thin film as claimed in claim 1, wherein a step of controlling the substrate chuck immersed into the chemical bath reaction container comprises repeating motions of tilting and leveling the substrate chuck several times to release trapped bubbles.

5. The method for fabricating a chemical compound thin film as claimed in claim 1, wherein the substrate chuck comprises a press stripe substrate fixing device, a screw substrate fixing device, a magnetic attachment substrate fixing device, or a vacuum absorption substrate fixing device.

6. The method for fabricating a chemical compound thin film as claimed in claim 1, wherein the reaction solution mixer comprises a spiral tube mixing device, a blade mixing device, or an eddy current mixing device.

7. The method for fabricating a chemical compound thin film as claimed in claim 1, wherein a heating mechanism of the temperature control system comprises a filament heating, a hydrothermal heating, an oil heating, and an infrared heating.

8. The method for fabricating a chemical compound thin film as claimed in claim 1, wherein the swing arm device comprises a suspension swing device to immerse a first end of the substrate chuck into the chemical reaction solution in the chemical bath reaction container so that the substrate chuck tilts at a suitable angle into the chemical reaction solution.

9. The method for fabricating a chemical compound thin film as claimed in claim 1, wherein the swing arm device comprises a retractable pile swing device to lower a first end of the substrate chuck so that the substrate chuck tilts at a suitable angle into the chemical reaction solution in the chemical bath reaction container.

10. The method for fabricating a chemical compound thin film as claimed in claim 1, wherein the chemical bath deposition apparatus is configured such that the bottom surface of the chemical bath reaction container is maintained in a horizontal position and the substrate chuck is tilted relative to the bottom surface prior to immersion of the substrate chuck, such that the substrate chuck and the bottom surface are not parallel at a point of immersion of the substrate chuck.

* * * * *